US007547219B2

(12) United States Patent
Zhuge

(10) Patent No.: US 7,547,219 B2
(45) Date of Patent: Jun. 16, 2009

(54) ELECTRICAL SAFETY ADAPTOR WITH REPLACEABLE HEAD UNIT

(76) Inventor: Rui Zhuge, 4B, 2th Building, Taihua Business Center, 10th District, Baoan, Shenzhen, Guangdong (CN)

( * ) Notice: Subject to any disclaimer, the term of this patent is extended or adjusted under 35 U.S.C. 154(b) by 421 days.

(21) Appl. No.: 11/578,612

(22) PCT Filed: Dec. 12, 2005

(86) PCT No.: PCT/CN2005/002155

§ 371 (c)(1),
(2), (4) Date: Oct. 12, 2006

(87) PCT Pub. No.: WO2007/003080

PCT Pub. Date: Jan. 11, 2007

(65) Prior Publication Data

US 2008/0293271 A1 Nov. 27, 2008

(30) Foreign Application Priority Data

Jul. 4, 2005 (CN) ..... 2005 1 0035558

(51) Int. Cl.
*H01R 29/00* (2006.01)

(52) U.S. Cl. ..... 439/173

(58) Field of Classification Search ..... 439/173, 439/172, 131, 139, 132–135, 518, 956, 652
See application file for complete search history.

(56) References Cited

U.S. PATENT DOCUMENTS

| | | | | | |
|---|---|---|---|---|---|
| 4,973,827 | A * | 11/1990 | Nozaki | 219/521 |
| 5,613,863 | A * | 3/1997 | Klaus et al. | 439/131 |
| 5,634,806 | A * | 6/1997 | Hahn | 439/173 |
| 5,848,907 | A * | 12/1998 | Chen | 439/172 |
| 6,042,400 | A * | 3/2000 | Queffelec et al. | 439/131 |
| 6,227,888 | B1 * | 5/2001 | Hahn | 439/173 |
| 7,008,246 | B2 * | 3/2006 | Zhuge | 439/173 |
| 7,300,297 | B1 * | 11/2007 | Wang | 439/173 |
| 7,439,709 | B2 * | 10/2008 | Bumiller | 320/114 |

* cited by examiner

*Primary Examiner*—Alexander Gilman
(74) *Attorney, Agent, or Firm*—Raymond Y. Chan; David and Raymond Patent Firm

(57) ABSTRACT

An electrical safety adaptor includes a receptacle including a plug housing and at least two resilient conductors, a replaceable head unit including a supporting platform slidably fitted on the plug housing in a detachably attaching manner and at least two plugging heads, and a safety arrangement slidably mounted on the replaceable head unit to enclose rear ends of the plugging heads in a hidden manner, wherein when the replaceable head unit is slid to engage with the receptacle, the safety arrangement is slidably pushed to expose the rear ends of the plugging heads for the resilient conductors conductively contacting thereto.

9 Claims, 6 Drawing Sheets

ELECTRICAL SAFETY ADAPTOR WITH REPLACEABLE HEAD UNIT

BACKGROUND OF THE PRESENT INVENTION

1. Field of Invention

The present invention relates to an electric plug for electrically connecting an electric appliance with an electric socket, and more particularly to an electrical safety adaptor adapted to be selectively interchanged for adapting to different electric sockets with respect to the different standards of the countries, wherein the electrical safety adaptor further provides a child safety feature of preventing the electrical safety adaptor directly plugging into the socket.

2. Description of Related Arts

Many different kinds of the existing AC electrical appliances are used around the world, especially the home electric appliances with portable feature are always carried from one place to another place. Such portable electrical appliances are chargers, AC to DC inverters, or appliances with built-in charging circuits to form an integrated structure. Some electrical appliances having a bigger size and heavier weight include a power plug extended from the body via an electric cable. No matter which types of the electric plugs are incorporated, the manufacturer only provides the electric plug corresponding to the safety standard of the country which the electric appliances are sale therein. In other words, there are different safety standards around the world, such as CCC standards in China, UL standards in the United States, UK standards in UK and GS standards in German, etc, the electric plug is not changeable such that even the manufacturers manufacture the same electric appliances, they have to change the corresponding electric plugs before the electric appliances are shipped to different countries. In addition, with the rapid development of international exchanges and world trade, it becomes a necessary approach in the single-systemization of world economics market and the internationality of electric appliances. In order to meet the different safety standards, the user and/or the manufacturer merely incorporate with an additional adapter for the electric plug. However, such adapter not only enlarges the size of the electric plug but also increases the manufacturing cost of the electric appliance.

In order to solve this problem, the applicant has applied a China patent application entitled "an electrical safety adaptor with replaceable head unit" having an application number 200420015275.4, wherein an electric plug incorporates with the detachable head unit which meets the standards of each country for solving the above mentioned problem. However, in order to connect the resilient conductors of the receptacle, the back part of the plug-in connector is unprotected. If a child put the electric plug into a socket, it may cause electric shock. Therefore, the applicant respectfully improves the electric plug which not only meets the standards of each country but also prevents the electric shock by separating the connector with the receptacle.

SUMMARY OF THE PRESENT INVENTION

A main object of the present invention is to solve the above prior art problems and provide an electrical safety adaptor with replaceable connector head which is suitable for the respective safety standards of different electric appliance and is adapted to prevent the replaceable connector plugging into the socket to cause electric shock.

Accordingly, in order to accomplish the above object, the present invention provides an electric safety adaptor which comprises a receptacle and a set of replaceable connector heads to replaceably connect with the receptacle, wherein the replaceable connector head comprises an insulated supporting platform and at least two plugging heads sized and shaped adapted for fitting into the corresponding electric socket. The replaceable connector head is detachably engaged with the receptacle at a position that two resilient conductors at the receptacle are connectively contacted with rear ends of the plugging heads respectively. Accordingly, the electric safety adaptor further comprises a safety arrangement movably mounted at the supporting platform to normally enclose the rear ends of the plugging heads in a hidden manner for preventing the replaceable connector head directly plugging into the electric socket to cause electric shock when a child touches the rear end of the plugging head. When the connector head is detachably engaged with the receptacle, the safety arrangement is moved to expose the rear ends of the plugging heads such that the two resilient conductors are conductively contacted with the rear ends of the plugging heads.

The safety arrangement comprises a sliding panel made of insulated material and a resilient element, wherein the sliding panel has two sliding side edge slidably engaging with two sliding tracks of the supporting platform respectively to expose the rear ends of the plugging heads. The resilient element applies an urging force against the insulated cover to ensure the sliding panel sliding back to its original position to cover the rear ends of the plugging heads.

Alternatively, the safety arrangement comprises a sliding panel made of insulated material, a resilient element, and a retaining cover, wherein the sliding panel has two sliding side edges slidably engaging with two sliding tracks of the supporting platform respectively to expose the rear ends of the plugging heads. The resilient element applies an urging force against the insulated cover to ensure the sliding panel sliding back to its original position to cover the rear ends of the plugging heads. The retaining cover is mounted at the supporting platform at a position the sliding panel is slid on the supporting platform until the sliding panel is blocked by the retaining cover to expose the rear ends of the plugging heads, so as to prevent a further sliding movement of the sliding panel.

Accordingly, the sliding panel is shaped to cover at the rear ends of the plugging heads, wherein the sliding panel has two guiding notches formed at two side portions thereof, in such a manner that when the supporting platform is slid on the receptacle, the sliding panel is pushed by the resilient conductors to expose the rear ends of the plugging heads such that the resilient conductors conductively contact with the rear ends of the plugging heads at the guiding notches of the sliding panel respectively. A first holder is formed at the sliding panel and a second holder is formed at the supporting platform, wherein the resilient element is retained between the first and second holders in position for applying the urging force against the sliding panel.

Alternatively, the sliding panel is shaped to cover at the rear ends of the plugging heads, wherein the sliding panel has two guiding notches formed at two side portions thereof, in such a manner that when the supporting platform is slid on the receptacle, the sliding panel is pushed by the resilient conductors to expose the rear ends of the plugging heads such that the resilient conductors conductively contact with the rear ends of the plugging heads at the guiding notches of the sliding panel respectively. The sliding panel further has two spaced apart sliding guiders extended at a position the sliding guiders guide the sliding panel sliding on the supporting platform to prevent a lateral movement of the sliding panel. A first holder is formed at the sliding panel and a second holder is formed at the supporting platform, wherein the resilient element is retained between the first and second holders in position for applying the urging force against the sliding panel.

The receptacle comprises a plug housing, at least two resilient conductors and an electric cable. The plug housing, having a box shape, has an engaging seat to receive the supporting platform. The engaging seat has two sliding grooves sidewardly formed at two side edges of the engaging seat respectively and two groove accesses formed at two sliding grooves respectively. The receptacle further comprises a locking latch movably protruded at the engaging seat and an actuation button provided on the receptacle to actuate the locking latch. The ends of the resilient conductors are spacedly and movably protruded from the engaging seat, wherein the electric cable is electrically coupling with the resilient conductors via an AC circuitry and is extended from the plug housing.

The AC circuitry can be a AC-to-DC inverting circuit, a rectifying circuit, a charging circuit or circuit for shaving device that can be selectively received in the plug housing.

The supporting platform comprises a plurality of engaging flanges integrally protruded from two side edges of said supporting platform, wherein the engaging flanges are slidably engaged with the sliding grooves at the groove accesses respectively to slidably mount said supporting platform to the engaging seat of the plug housing. The replaceable connector head can have two plugging heads or three plugging heads spacedly affixing at the supporting platform, wherein the rear ends of the plugging heads are extended in an exposing manner to conductively contact with the resilient conductors respectively.

Accordingly, the present invention provides a safety feature is that the replaceable connector head is detachably mounted to the receptacle such that the user is able to interchange the desired replaceable connector head corresponding to the safety standard of the country so as to enhance the practice use of the present invention. In addition, the manufacturer is able to sell the electrical appliance to those counties such that the user is able to use those electrical appliances therein. In other words, the present invention not only makes the users convenient but also makes the assemblies of the producers fast to lower the manufacturing cost. Most important of all, an electric safety adaptor keeps the unprotect part of the plugging head in a hidden manner for preventing the children from electric shock especially when the replaceable connector head is plugged into the electric socket.

These and other objectives, features, and advantages of the present invention will become apparent from the following detailed description, the accompanying drawings, and the appended claims.

DETAILED DESCRIPTION OF THE PREFERRED EMBODIMENT

Figure 1:
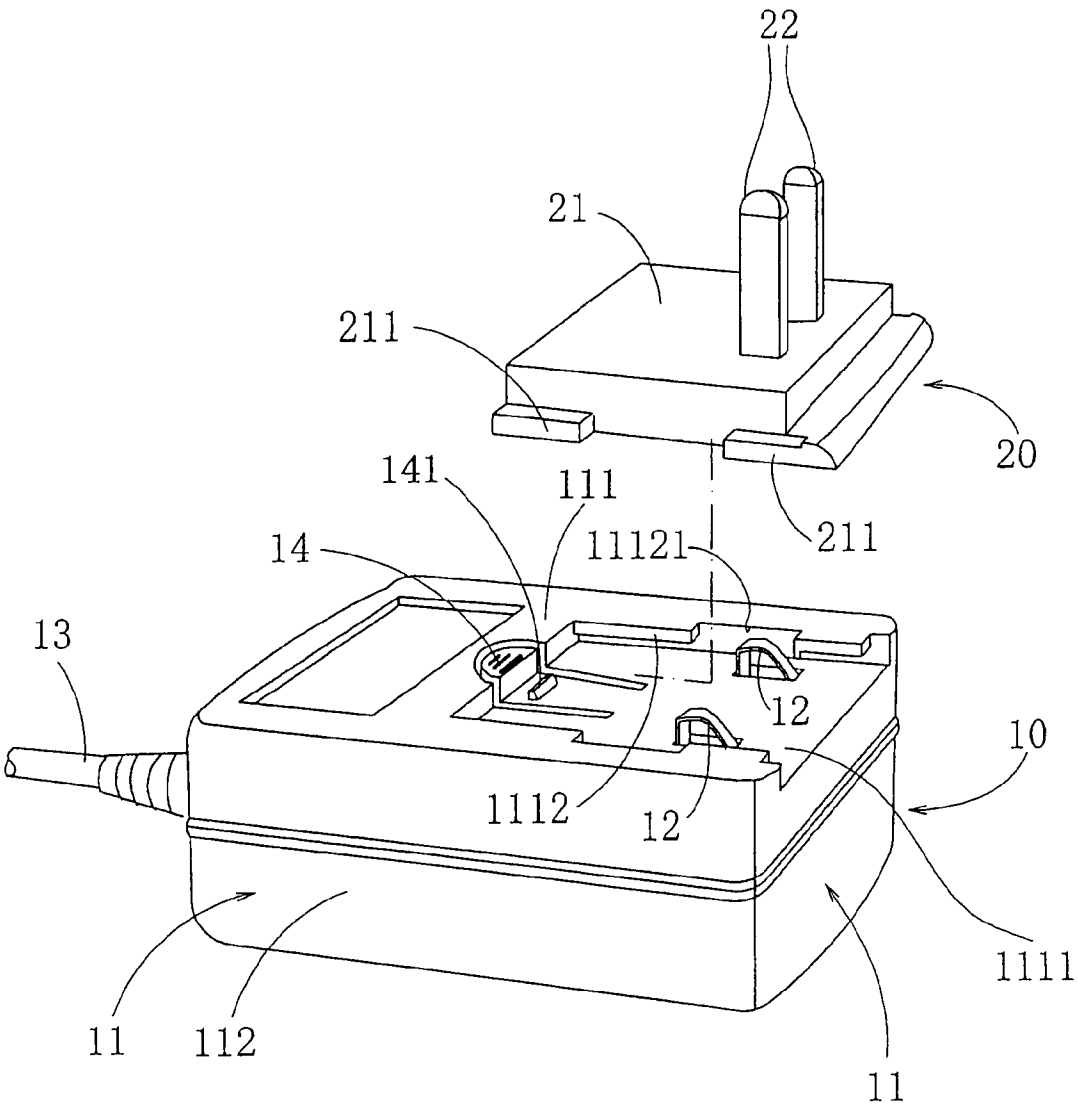
FIG. 1 is an exploded perspective view of an electrical safety adaptor according to a preferred embodiment of the present invention.
Figure 2:
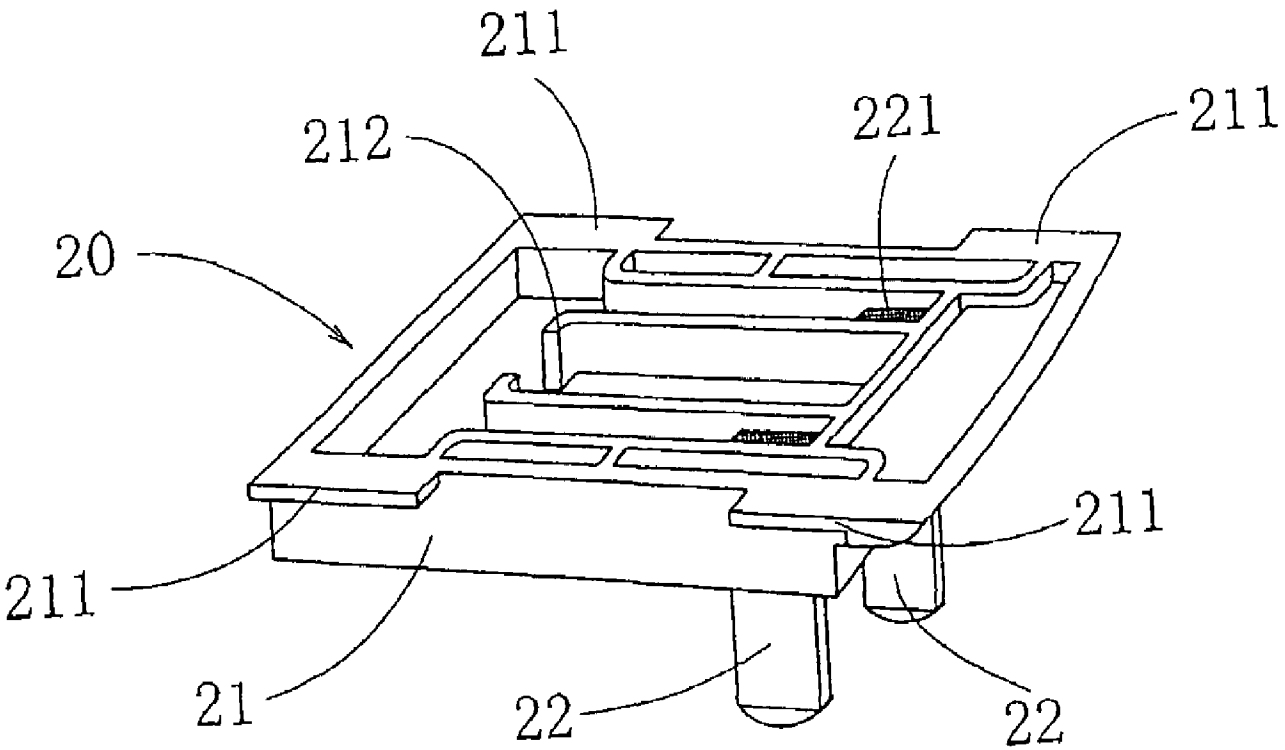
FIG. 2 is a perspective view of a replaceable head unit of the electrical safety adaptor according to the above preferred embodiment of the present invention.
Figure 3A:
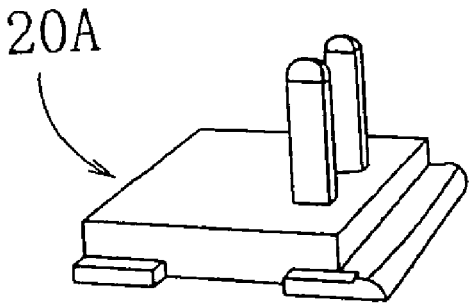
FIGS. 3A to 3D are perspective views of the replaceable head unit according to the above preferred embodiment of the present invention, illustrating various types of plugging heads for different safety standards in the world including China, United States, German and United Kingdom respectively.
Figure 3B:
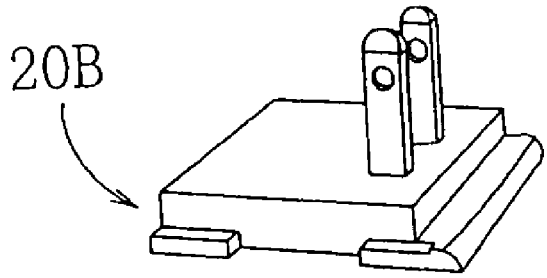
Figure 3C:
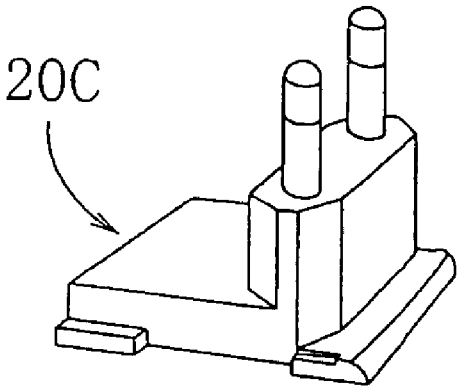
Figure 3D:
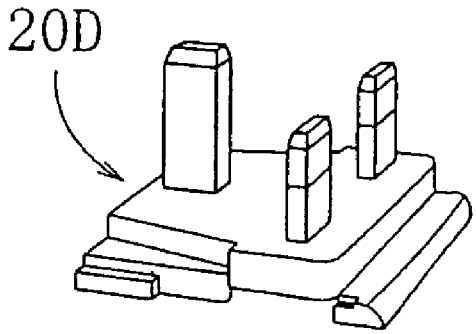

Referring to FIG. 1 of the drawings, an electrical safety adaptor for an electric socket according to a preferred embodiment of the present invention is illustrated, wherein the electrical safety adaptor comprises a receptacle 10 and at least a replaceable head unit 20 detachably mounting to the receptacle 10. The receptacle 10 comprises a plug housing 11 having an engaging seat 1111, at least two resilient conductors 12 spacedly provided on the engaging seat 1111 of the plug housing 11, and an electric cable 13. The plug housing 11 comprises an upper casing 111 and a lower casing 112 mounted thereto to form a box-shape structure, wherein the engaging seat 1111 is formed on the upper casing 111 to detachably engage with the replaceable head unit 20. Accordingly, the engaging seat 1111 has two sliding grooves 1112 sidewardly formed at two side edges of the engaging seat 1111 respectively and two groove accesses 11121 formed at two sliding grooves 1112 respectively. The resilient conductors 12 are spacedly mounted on the engaging seat 1111 of the plug housing 11 at a position between the two sliding grooves 1112. Each of the resilient conductors 12 are movably protruded from the engaging seat 1111 wherein the resilient conductors 12 are adapted to be pressed on the engaging seat 1111 when an external force is pressed on the resilient conductors 12. The replaceable head unit 20 comprises a supporting platform 21 slidably fitted into the engaging seat 1111 in a detachably attaching manner, and at least two plugging heads 22 which are spacedly extended from the supporting platform 21 and are sized and shaped adapted for fitting into the electric socket, wherein each of the plugging heads 22 has a rear end 221 penetrated through the supporting platform 21 as an electric contacting link. When the supporting platform 21 is slid in the engaging seat 111 of the plug housing 11 to detachably mount the replaceable head unit 20 to the receptacle 10, the two resilient conductors 12 are conductively contacted with the rear ends 221 of the plugging heads 22 respectively so as to electrically connect the plugging heads 22 with the AC circuitry. In other words, the two resilient conductors 12 are two spring wires protruding on the engaging seat 1111 adapted for applying an urging force against the supporting platform 21 to not only retain the supporting platform 21 at the engaging seat 1111 but also ensure the conductively contact with the rear ends 221 of the plugging heads 22. Accordingly, the supporting platform 21 comprises a plurality of engaging flanges 211 integrally protruded from two side edges of the supporting platform 21 wherein the engaging flanges 211 are slidably engaged with the sliding grooves 1112 to slidably mount the supporting platform 21 to the engaging seat 111 of the plug housing 11. It is worth to mention that a thickness of each of the engaging flanges 211 is slightly smaller than a width of the sliding groove 1112 such that the engaging flanges 211 are fittingly slotted into the sliding groove 1112 to detachably mount the supporting platform 21 on the engaging seat 111. In other words, the engaging flanges 211 are slid into the sliding grooves 1112 through the groove accesses 11121 respectively to retain the supporting platform 21 at the engaging seat 111 so as to prevent an unwanted lateral movement of the replaceable head unit 20 with respect to the receptacle 10. The electrical safety adaptor further comprises means for locking the supporting platform 21 on the engaging seat 1111. The locking means comprises a locking flange 212 formed on the supporting platform 21, a locking latch 141 movably provided at the engaging seat 1111 and aligned with the locking flange 212 when the supporting platform 21 is slid on the engaging seat 1111, and an actuation button 14 provided on the receptacle 10 to actuate the locking latch 141 to releasably engage with the locking flange 212 so as to lock up the supporting platform 21 on the engaging seat 1111. When the actuation button 14 is depressed to release the locking engagement between the locking latch 141 and the locking flange 212, the replaceable head unit 20 is adapted to be detached from the receptacle 10. The locking flange 212 is formed on a bottom side of the supporting platform 21 and the locking latch 141 is movably extended at an inner edge of the engaging seat 1111 to detachably engage with the locking flange 212 when the supporting platform 21 is slid on the engaging seat 1111. The rear ends 221 of the plugging heads 22 are located in an exposed manner as shown in FIG. 2. It is worth to mention that the plugging heads 22 are designed for a particular safety standard of the electric socket. Therefore, the receptacle 10 of the present invention can incorporate with different types of replaceable head unit 20A, 20B, 20C, 20D, as shown in FIGS. 3A to 3D, which meet the safety standards of different countries such as China, United States, German, and British. In other words, the replaceable head units 20, 20A, 20B, 20C, 20D are interchangeable to fit into the receptacle 10. Thus, the electric cable 13 is extended from the plug housing 11 to electrically connect to the AC circuitry so as to prevent the electric leakage of the present invention. Accordingly, the AC circuitry can be a AC-to-DC inverting circuit, a rectifying circuit, a charging circuit or circuit for shaving device that can be selectively received in the plug housing 11.

Figure 4C:
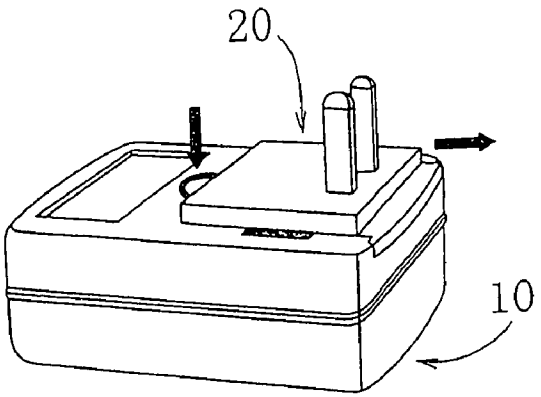
FIGS. 4A to 4C illustrate the detachably attaching operation of the electrical safety adaptor according to the above preferred embodiment of the present invention.
Figure 4B:
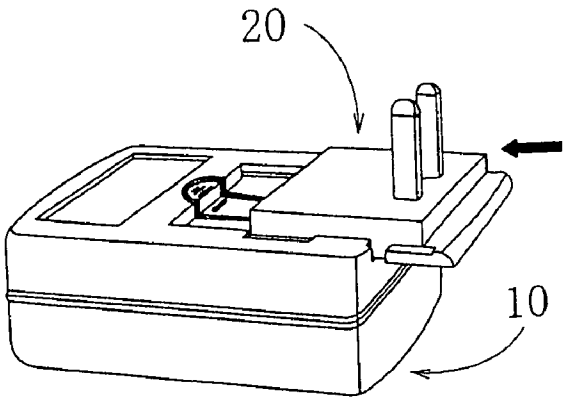
Figure 4A:
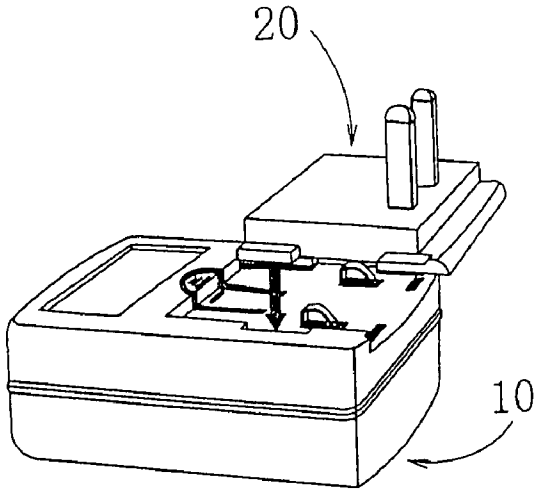

As shown in FIGS. 2 and 4, in order to mount the replaceable head unit 20 to the receptacle 10, the engaging flanges 211 are slid into the sliding grooves 1112 through the groove accesses 11121 respectively, as shown in FIG. 4A. Then, the supporting platform 21 is slid in the engaging seat 1111, as shown in FIG. 4B, until the locking latch 141 is engaged with the locking flange 212 to lock up the supporting platform 21 at the engaging seat 1111, as shown in FIG. 4C. Therefore, the two resilient conductors 12 are conductively contacted with the rear ends 221 of the plugging heads 22 respectively so as to electrically connect the plugging heads 22 with the AC circuitry. For interchanging the replaceable head unit 20, the user is able to press on the actuation button 14 to release the locking engagement between the locking latch 141 and the locking flange 212 such that the replaceable head unit 20 is adapted to be slidably detached from the receptacle 10.

Figure 5:
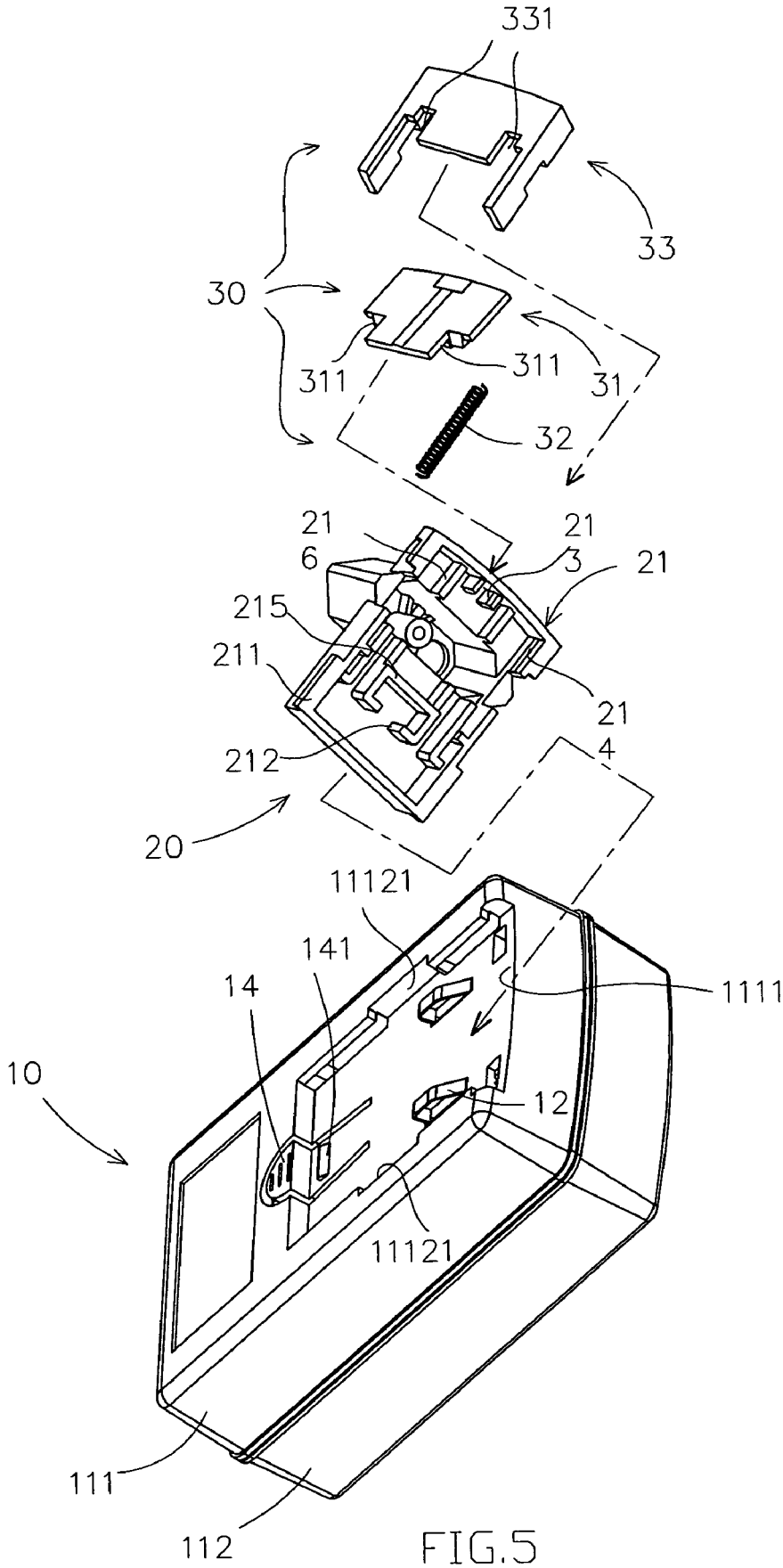
FIG. 5 is an exploded perspective view of the electrical safety adaptor according to the above preferred embodiment of the present invention, illustrating the safety arrangement incorporating with the replaceable head unit.
Figure 6:
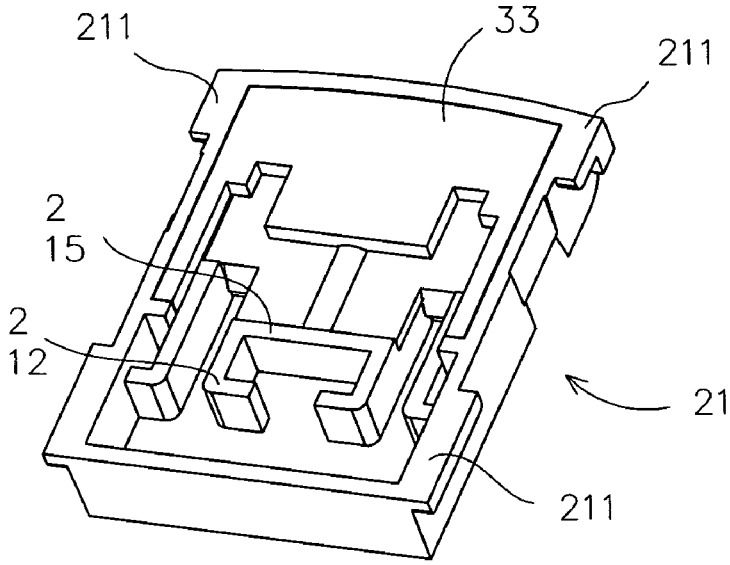
FIG. 6 is a perspective of the replaceable head unit with the safety arrangement according to the above preferred embodiment of the present invention.
Figure 7:
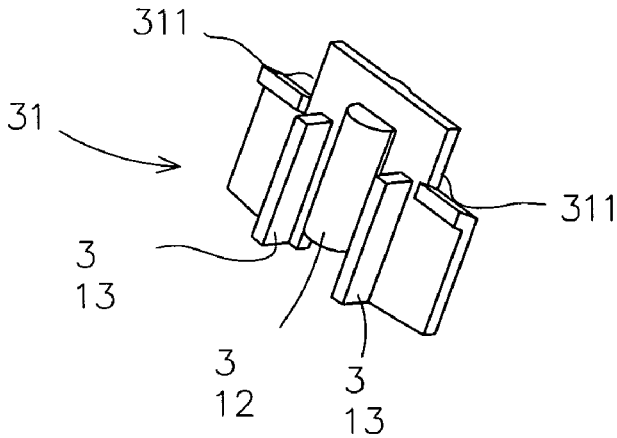
FIG. 7 is a perspective view of the sliding panel of the safety arrangement according to the above preferred embodiment of the present invention.

According to the preferred embodiment, the electrical safety adaptor further comprises a safety arrangement 30 incorporating with the supporting platform 21 of the replaceable head unit 20 for enclosing the rear ends of the plugging heads 22 when the replaceable head unit 20 is detached from the receptacle 10, as shown in FIGS. 5 and 6. The safety arrangement 30 comprises a sliding panel 31 and a resilient element 32. As shown in FIG. 7, the sliding panel 31 is shaped to cover at the rear ends 221 of the plugging heads 22. The supporting platform 21 has two spaced apart sliding tracks 214 slidably engaging with two sliding edges of the sliding panel 31 such that the sliding panel 31 is slid to enclose the rear ends 221 of the plugging heads 22. The sliding panel 31 has two guiding notches 311 formed at two side portions thereof wherein when the engaging flanges 211 of the supporting platform 21 engage with the receptacle 10, the resilient conductors 22 are located at the guiding notches 311 respectively. When the replaceable head unit 20 is slidably pushed to engage at the receptacle 10, the resilient conductors 22 push the sliding panel 31 until a rear edge of the sliding panel 31 is blocked at a rear edge of the supporting platform 21. Therefore, the sliding panel 31 is slid to expose the rear ends 221 of the plugging heads 22 such that the resilient conductors 12 conductively contact with the rear ends 221 of the plugging heads 22, so as to electrically connect the replaceable head unit 20 with the receptacle 10. Furthermore, the sliding panel 31 further has a first holder 312 while the supporting platform 21 has a corresponding second holder 213 aligning with the first holder 312 when the sliding panel 31 is slidably engaged with the supporting platform 21. The resilient element 32, which is embodied as a compression spring, has two ends held by the first and second holders 312, 213 between the sliding panel 31 and the supporting platform 21, wherein the resilient element 32 is adapted for applying an urging force against the sliding panel 31 to push the sliding panel 31 back to its original position to enclose the rear ends 221 of the plugging heads 22. In other words, when the replaceable head unit 20 detached from the receptacle 10, the sliding panel 31 is slidably moved back to cover at the rear ends 221 of the plugging heads 22 via the resilient element 32, so as to prevent the electric shock when a child only plugs the replaceable head unit 20 into the electric socket.

Figure 8:
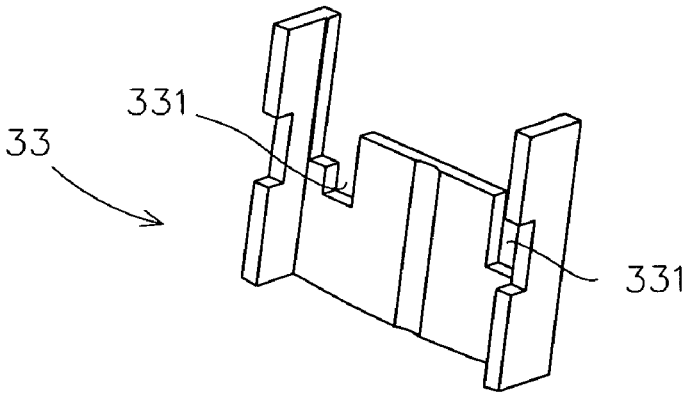
FIG. 8 is a perspective view of the retaining cover of the safety arrangement according to the above preferred embodiment of the present invention.

Accordingly, the safety arrangement 30 further comprises a retaining cover 33. As shown in FIG. 5, the sliding panel 31 is movably mounted at the bottom side of the supporting platform 21 by sliding engaging the two side edges of the sliding panel 31. As shown in FIG. 7, the sliding panel 31 has the guiding notches 311 formed at two side portions thereof such that when the replaceable connector head 20 is slid forward to engage with the receptacle 10, the resilient conductors 12 conductively contact with the rear ends 221 of the plugging heads 22 through the guiding notches 311. The sliding panel 31 further has two spaced apart first sliding guiders 313 transversely extended at a position that the first holder 312 is positioned between the first sliding guiders 313. Correspondingly, the supporting platform 21 further has two spaced apart second sliding guiders 216 slidably engaging with the first sliding guiders 313 at a position that the first sliding guiders 313 are slidably coupled between the second sliding guider 216, so as to prevent a lateral movement of the sliding panel 31 with respect to the supporting platform 21. The supporting platform 21 further has a longitudinal blocking guider 215 extended at a position that when the sliding panel 21 is slidably blocked at the blocking guider 215, the sliding panel 21 encloses the rear ends 221 of the plugging heads 22, so as to ensure the rear ends 221 of the plugging heads 22 is in a hidden manner. Accordingly, the second holder 213 is positioned between the second sliding guider 216 to align with the first holder 312 such that the resilient element 32 is held between the first and second holders 312, 213 when the sliding panel 21 is slidably mounted at the supporting platform 21. As shown in FIG. 8, the retaining cover 33 generally has a U-shaped cross section, wherein the retaining cover 33 is mounted at the supporting platform 21 via ultrasonic wedding to limit the sliding movement of the sliding panel 31. Accordingly, the height of the retaining cover 33 is corresponding to the depth of the engaging seat 1111 such that when the retaining cover 33 is mounted at the supporting platform 21, the retaining cove 33 and the supporting platform 21 form a flat peripheral surface. The retaining cover 33 has two aligning notches 331 aligning with the guiding notches 311 of the sliding panel 31 respectively such that when the sliding panel 31 is slid to expose the rear ends 221 of the plugging heads 22, the resilient conductors 12 are conductively contact with the rear ends 221 of the plugging heads 22 through the aligning notches 331 respectively.

One skilled in the art will understand that the embodiment of the present invention as shown in the drawings and described above is exemplary only and not intended to be limiting. It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An electrical safety adaptor for an electric socket, comprising:

a receptacle comprising a plug housing and at least two resilient conductors spacedly provided on said plug housing;

a replaceable head unit comprising a supporting platform slidably fitted on said plug housing in a detachably attaching manner, and at least two plugging heads which are spacedly extended from said supporting platform and are sized and shaped adapted for fitting into said electric socket, wherein each of said plugging heads has a rear end extended through said supporting platform, wherein when said supporting platform is slid on said plug housing to detachably mount said replaceable head unit to said receptacle, said two resilient conductors are conductively contacted with said rear ends of said plugging heads respectively so as to electrically connect said replaceable head unit with said receptacle; and a safety arrangement slidably mounted on said replaceable head unit to enclose said rear ends of said plugging heads in a hidden manner, wherein when said replaceable head unit is slid to engage with said receptacle, said safety arrangement is slidably pushed to expose said rear ends of said plugging heads for said resilient conductors conductively contacting thereto.

2. The electrical safety adaptor, as recited in claim 1, wherein said safety arrangement comprises a sliding panel having two sliding edges slidably engaging with two spaced apart sliding tracks of said supporting platform to slidably enclose said rear ends of said plugging heads, and a resilient element supported between said sliding panel and said supporting platform for applying an urging force against said sliding panel to retain said sliding panel at a position that said rear ends of said plugging heads are covered by said sliding panel.

3. The electrical safety adaptor, as recited in claim 1, wherein said safety arrangement comprises a sliding panel having two sliding edges slidably engaging with two spaced apart sliding tracks of said supporting platform to slidably enclose said rear ends of said plugging heads, a retaining cover mounted at said supporting platform to cover said sliding panel and to limit a sliding movement thereof, and a resilient element supported between said sliding panel and said supporting platform for applying an urging force against said sliding panel to retain said sliding panel at a position that said rear ends of said plugging heads are covered by said sliding panel.

4. The electrical safety adaptor, as recited in claim 2, wherein said sliding panel has two guiding notches formed at a position that when said supporting platform is slid to engage with said receptacle, said resilient conductors push said sliding panel at said guiding notches respectively to expose said rear ends of said plugging heads so as to conductively contact therewith, wherein said sliding panel further has a first holder while said supporting platform has a corresponding second holder aligning with said first holder when said sliding panel is slidably engaged with said supporting platform, wherein said resilient element is retained between said first and second holders.

5. The electrical safety adaptor, as recited in claim 3, wherein said sliding panel has two guiding notches formed at a position that when said supporting platform is slid to engage with said receptacle, said resilient conductors push said sliding panel at said guiding notches respectively to expose said rear ends of said plugging heads so as to conductively contact therewith, wherein said sliding panel further has a first holder and two spaced apart sliding guiders slidably engaging with said supporting platform for preventing a lateral movement of said sliding panel with respect to said supporting platform, wherein said supporting platform has a corresponding second holder aligning with said first holder when said sliding panel is slidably engaged with said supporting platform, wherein said resilient element is retained between said first and second holders.

6. The electrical safety adaptor, as recited in claim 3, wherein said retaining cover has a sized and shaped that said retaining cover is mounted on said supporting platform to form a flat peripheral surface of said replaceable head unit, wherein said retaining cover has two aligning notches aligning with the resilient conductors.

7. The electrical safety adaptor, as recited in claim 1, wherein said plug housing formed in a box shape having an engaging seat at said plug housing and defining two sliding grooves at two side edges of said engaging seat to slidably engage with said replaceable connector head, wherein said replaceable head unit comprises a locking flange formed on said supporting platform, a locking latch movably provided at said engaging seat and aligned with said locking flange when said supporting platform is slid on said engaging seat, and an actuation button provided on said receptacle to actuate said locking latch to releasably engage with said locking flange so as to lock up said supporting platform on said engaging seat, wherein said receptacle further comprises a AC circuitry received in said plug housing and an electric cable which is extended from said plug housing and is electrically connected to said resilient conductors through said AC circuitry.

8. The electrical safety adaptor, as recited in claim 7, wherein said AC circuitry is selected from the group consisting of a AC-to-DC inverting circuit, a rectifying circuit, a charging circuit or a circuit for a shaving device.

9. The electrical safety adaptor, as recited in claim 1, wherein said supporting platform comprises a plurality of engaging flanges integrally protruded from two side edges thereof to slidably engage with said receptacle and a longitudinal blocking guider extended at a position that when said safety arrangement is slidably blocked at said blocking guider, said safety arrangement encloses said rear ends of said plugging heads, so as to ensure said rear ends of said plugging heads is in a hidden manner.

* * * * *